US005893015A

United States Patent [19]

Mojarradi et al.

[11] Patent Number: 5,893,015

[45] **Date of Patent: *Apr. 6, 1999**

[54] FLEXIBLE DONOR BELT EMPLOYING A DC TRAVELING WAVE

[75] Inventors: Mohammad M. Mojarradi, Pullman, Wash.; James M. Donohue, Las Vegas, Nev.; Tuan Anh Vo, Hawthorne, Calif.

[73] Assignee: Xerox Corporation, Stamford, Conn.

[ * ] Notice: The term of this patent shall not extend beyond the expiration date of Pat. No. 5,717,986.

[21] Appl. No.: 670,734

[22] Filed: Jun. 24, 1996

(Under 37 CFR 1.47)

[51] Int. Cl.[6] ..... G03G 15/06

[52] U.S. Cl. ..... 399/291; 399/266; 399/285; 399/289

[58] Field of Search ..... 399/290, 291, 399/266, 285, 289

[56] References Cited

U.S. PATENT DOCUMENTS 4,647,179 3/1987 Schmidlin .

5,717,986 2/1998 Vo et al. ..... 399/291

*Primary Examiner*—S. Lee

*Attorney, Agent, or Firm*—Lloyd F. Bean II

[57] ABSTRACT

An apparatus for transporting charged particles in a predetermine path which includes a donor member that is adapted to move charged particles on the surface thereof in the predetermined path. The donor member includes an electrode array on the outer surface thereof; the array including a plurality of spaced apart electrodes extending substantially across width of the surface of the donor member. A multiphase DC voltage source is operatively coupled to the electrode array, the phase being shifted with respect to each other such as to create an electrodynamic wave pattern capable of moving charged particles on the surface thereof in the predetermined path.

12 Claims, 6 Drawing Sheets

FLEXIBLE DONOR BELT EMPLOYING A DC TRAVELING WAVE

BACKGROUND OF THE INVENTION

This invention relates generally to a development apparatus for ionographic or electrophotographic imaging and printing apparatuses and machines, and more particularly is directed to a flexible development web or belt with interdigitated electrodes therein which are controlled to transport toner on the surface thereof and to form a toner cloud in the development zone for the development of a latent electrostatic image.

INCORPORATION BY REFERENCE

The following is specifically incorporated by reference U.S. patent application Ser. No. 08/668,759, now U.S. Pat. No. 5,717,986 entitled "FLEXIBLE DONOR BELT" filed concurrently herewith.

Generally, the process of electrophotographic printing includes charging a photoconductive member to a substantially uniform potential so as to sensitize the surface thereof. The charged portion of the photoconductive surface is exposed to a light image from either a scanning laser bean or an original document being reproduced. This records an electrostatic latent image on the photoconductive surface. After the electrostatic latent image is recorded on the photoconductive surface, the latent image is developed. Two component and single component developer materials are commonly used for development. A typical two component developer comprises magnetic carrier granules having toner particles adhering triboelectrically thereto. A single component developer material typically comprises toner particles. Toner particles are attracted to the latent image forming a toner powder image on the photoconductive surface, the toner powder image is subsequently transferred to a copy sheet, and finally, the toner powder image is heated to permanently fuse it to the copy sheet in image configuration.

The electrophotographic marking process given above can be modified to produce color images. One color electrophotographic marking process, called image on image processing, superimposes toner powder images of different color toners onto the photoreceptor prior to the transfer of the composite toner powder image onto the substrate. While image on image process is beneficial, it has several problems. For example, when recharging the photoreceptor in preparation for creating another color toner powder image it is important to level s the voltages between the previously toned and the untoned areas of the photoreceptor.

In the application of the toner to the latent electrostatic images contained on the charge-retentive surface, it is necessary to transport the toner from a developer housing to the surface. A basic limitation of conventional xerographic development systems, including both magnetic brush and single component, is the inability to deliver toner(i.e. charged pigment) to the latent images without creating large adhesive forces between the toner and the conveyor which transport the toner to latent images. As will be appreciated, large fluctuation (i.e. noise) in the adhesive forces that cause the pigment to tenaciously adhere to the carrier severely limit the sensitivity of the developer system thereby necessitating higher contrast voltages forming the images. Accordingly, it is desirable to reduce such noise particularly in connection with latent images formed by contrasting voltages.

In order to minimize the creation of such fluctuation in adhesive forces, there is provided, in the preferred embodiment of the invention a toner conveyor including means for generating traveling electrostatic waves which can move the toner about the surface of the conveyor with minimal contact therewith.

Traveling waves have been employed for transporting toner particles in a development system, for example 4,647,179 to Schmidlin which is hereby incorporated by reference. In that patent, the traveling wave is generated by alternating voltages of three or more phases applied to a linear array of conductors placed abut the outer periphery of the conveyor. The force F for moving the toner about the conveyor is equal QE t where Q is the charge on the toner and E t is the tangential field supplied by a multi-phase a.c. voltage applied to the array of conductors. Toner is presented to the conveyor by means of a magnetic brush which is rotated in the same direction as the traveling wave. This gives an initial velocity to the toner particles which enables toner having a much lower charge to be propelled by the wave. However, the achievement of high reliability and simple, economic manufacturability of the system continue to present problems.

SUMMARY OF THE INVENTION

Briefly, the present invention obviates the problems noted above by utilizing an apparatus for developing an image. The development system of the present invention enables greater simplicity and latitudes in developing high quality, full color images with an image on image process. Furthermore, the present invention enables high speed development with a donor belt which makes possible a smaller development housing and printing machines.

There is provided an apparatus for transporting charged particles in a predetermine path including a donor member and being adapted to charged particles on the surface thereof in the predetermined path, said donor member includes an electrode array on the outer surface thereof, said array including a plurality of spaced apart electrodes extending substanial across width of the surface of the donor member; and a multi-phase DC voltage source operatively coupled to said electrode array, the phase being shifted with respect to each other such as to create an electrodynamic wave pattern capable of moving charged particles on the surface thereof in the predetermined path.

Another aspect of the invention there is provided an apparatus for developing a latent image recorded on an imaging surface, including: a housing defining a chamber storing a supply of developer material comprising toner; a donor member spaced from the imaging surface and being adapted to transport toner on the surface thereof to a region opposed from the imaging surface, said donor member includes an electrode array on the outer surface thereof, said array including a plurality of spaced apart electrodes extending substanial across width of the surface of the donor member; and a multi-phase DC voltage source operatively coupled to said electrode array, the phase being shifted with respect to each other such as to create an electrodynamic wave pattern capable of moving toner particles to and from a development zone for developing the latent image.

Yet another aspect of the invention there is provided an electrophotographic printing machine, wherein an electrostatic latent image recorded on an imaging surface of a photoconductive member is developed to form a visible image thereof, wherein the improvement includes a housing defining a chamber storing a supply of developer material comprising toner; a donor member spaced from the imaging surface and being adapted to transport toner on the surface thereof to a region opposed from the imaging surface, said donor member includes an electrode array on the outer surface thereof, said array including a plurality of spaced apart electrodes extending substanial across width of the surface of the donor member; and a multi-phase DC voltage source operatively coupled to said electrode array, the phase being shifted with respect to each other such as to create an electrodynamic wave pattern capable of moving toner particles to and from a development zone for developing the latent image.

Inasmuch as the art of electrophotographic printing is well known, the various processing stations employed in the printing machine will be shown hereinafter schematically and their operation described briefly with reference thereto.

Figure 1:
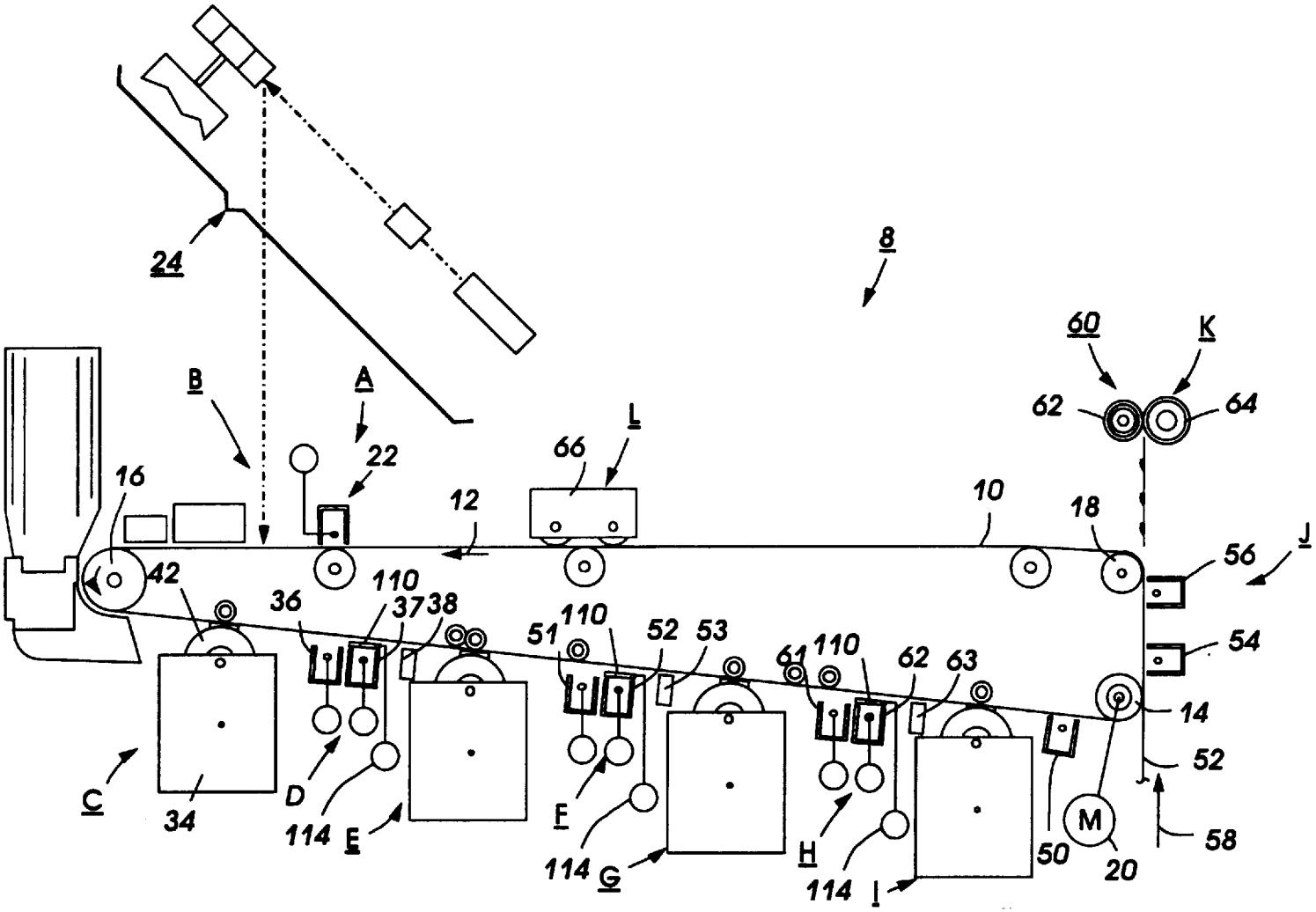
FIG. 1 is a schematic elevational view of an illustrative electrophotographic printing or imaging machine or apparatus incorporating a development apparatus having the features of the present invention therein.

Referring initially to FIG. 1, there is shown an illustrative electrophotographic machine having incorporated therein the development apparatus of the present invention. An electrophotographic printing machine creates a color image in a single pass through the machine and incorporates the features of the present invention. The printing machine uses a charge retentive surface in the form of an Active Matrix (AMAT) photoreceptor belt 10 which travels sequentially through various process stations in the direction indicated by the arrow 12. Belt travel is brought about by mounting the belt about a drive roller 14 and two tension rollers 16 and 18 and then rotating the drive roller 14 via a drive motor 20.

As the photoreceptor belt moves, each part of it passes through each of the subsequently described process stations. For convenience, a single section of the photoreceptor belt, referred to as the image area, is identified. The image area is that part of the photoreceptor belt which is to receive the toner powder images which, after being transferred to a substrate, produce the final image. While the photoreceptor belt may have numerous image areas, since each image area is processed in the same way, a description of the typical processing of one image area suffices to fully explain the operation of the printing machine.

Figure 2A:
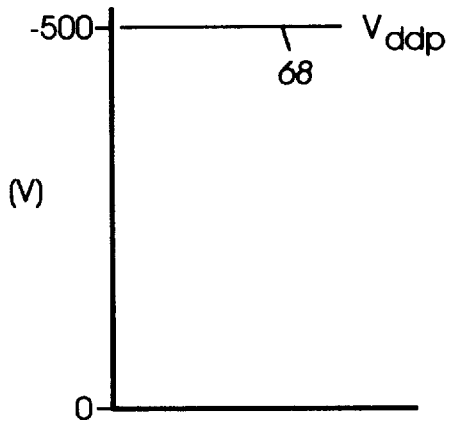
FIG. 2A shows a typical voltage profile of an image area in the electrophotographic printing machines illustrated in FIG. 1 after that image area has bee charged.

As the photoreceptor belt 10 moves, the image area passes through a charging station A. At charging station A, a corona generating device, indicated generally by the reference numeral 22, charges the image area to a relatively high and substantially uniform potential. FIG. 2A illustrates a typical voltage profile 68 of an image area after that image area has left the charging station A. As shown, the image area has a uniform potential of about −500 volts. In practice, this is accomplished by charging the image area slightly more negative than —500 volts so that any resulting dark decay reduces the voltage to the desired —500 volts. While FIG. 2A shows the image area as being negatively charged, it could be positively charged if the charge levels and polarities of the toners, recharging devices, photoreceptor, and other relevant regions or devices are appropriately changed.

Figure 2B:
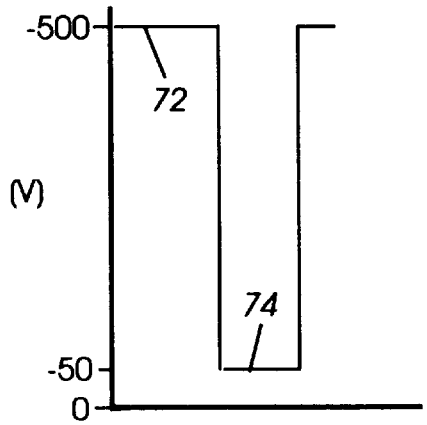
FIG. 2B shows a typical voltage profile of the image area after being exposed.

After passing through the charging station A, the now charged image area passes through a first exposure station B. At exposure station B, the charged image area is exposed to light which illuminates the image area with a light representation of a first color (say black) image. That light representation discharges some parts of the image area so as to create an electrostatic latent image. While the illustrated embodiment uses a laser based output scanning device 24 as a light source, it is to be understood that other light sources, for example an LED printbar, can also be used with the principles of the present invention. FIG. 2B shows typical voltage levels, the levels 72 and 74, which might exist on the image area after exposure. The voltage level 72, about −500 volts, exists on those parts of the image area which were not illuminated, while the voltage level 74, about −50 volts, exists on those parts which were illuminated. Thus after exposure, the image area has a voltage profile comprised of relative high and low voltages.

After passing through the first exposure station B, the now exposed image area passes through a first development station C which is identical in structure with development system E, G, and I. The first development station C deposits a first color, say black, of negatively charged toner 31 onto the image area. That toner is attracted to the less negative sections of the image area and repelled by the more negative sections. The result is a first toner powder image on the image area.

Figure 3:
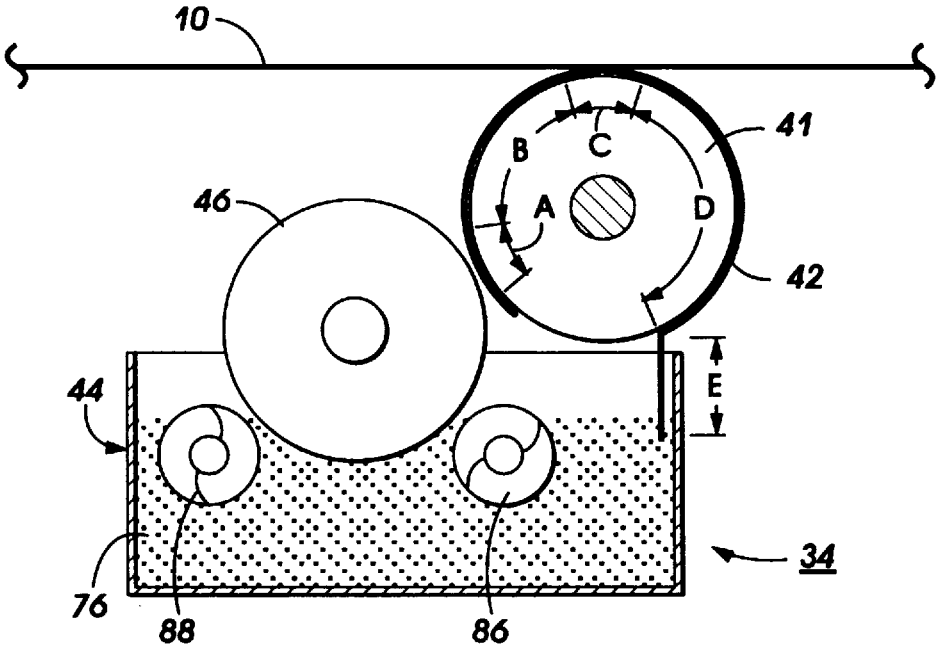
FIG. 3 Is a schematic elevational view showing the development apparatus used in the FIG. 1 printing machine.
Figure 4:
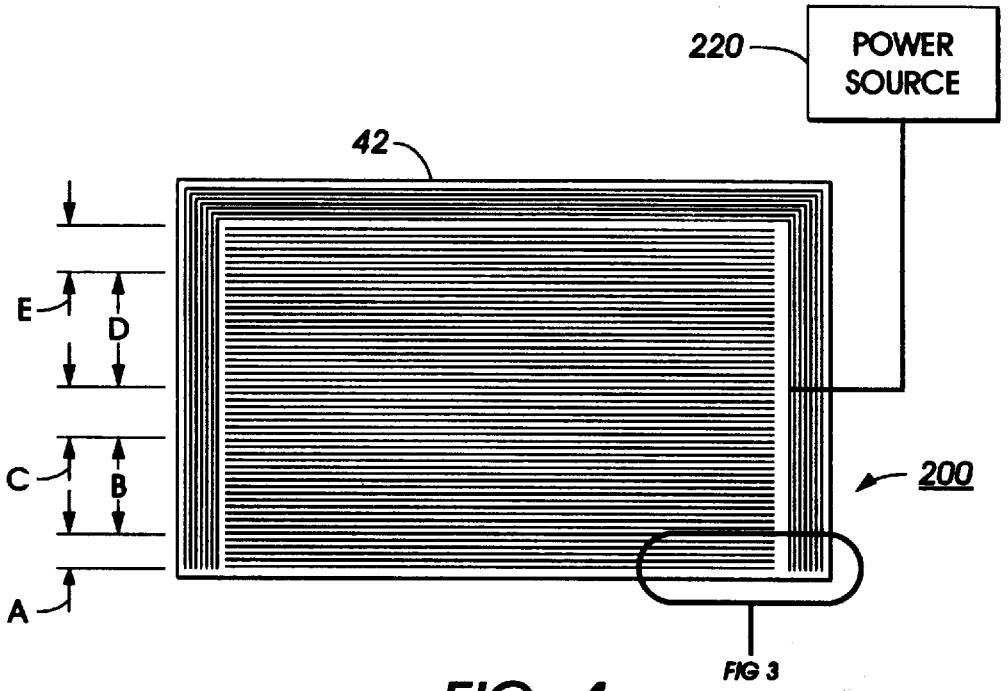
FIGS. 4 and 5 are top view of a portion of the flexible donor belt of the present invention.
Figure 5:
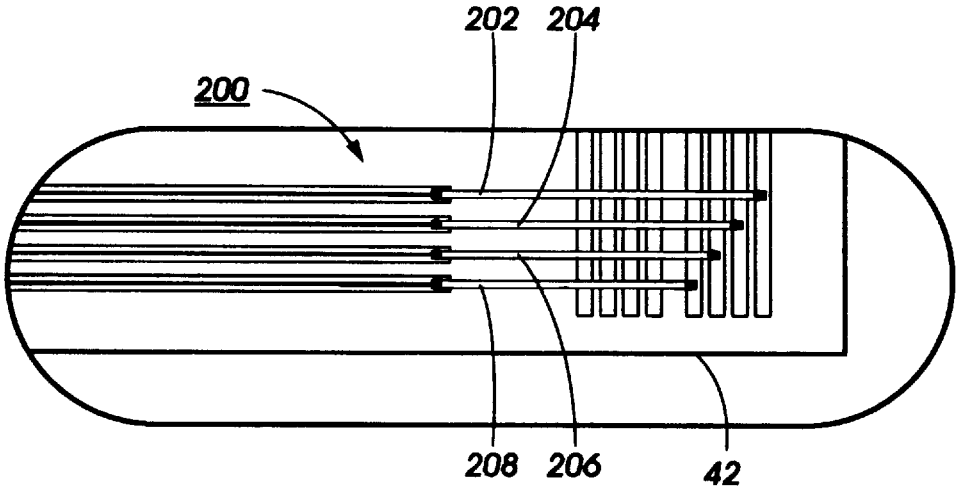

For the first development station C, development system 34 includes a flexible donor belt 42 having groups of electrode arrays near the surface of the belt. As illustrated in FIGS. 3–5, Electrode array 200 has group areas A–F in which each group area is individual addressable to perform the function of: Loading; Transferring; Developing; Transferring and Unloading. Each electrode array group area is independently addressable and operatively connected to voltage source 220 in order to supply a voltage in the order of □0–1000 volts AC or DC to each group area. The electrodes array group area A picks up the toner from the magnetic brush. Electrode array group areas B and D connected to the voltage source via phase shifting circuitry (see FIG. 8) such that a traveling wave pattern is established. The electrostatic field forming the traveling wave pattern pushes the charged toner particles about the surface of the donor belt from the magnetic brush 76 to the belt 10 where they are transferred to the latent electrostatic images on the belt by electrode group area C which generates a toner cloud in the development zone. Thereafter, toner is moved by electrode array group area D where electrode group area E is bias to unload remaining toner off the belt. The development system of the present invention will be discuss in greater detail supra.

Figure 2C:
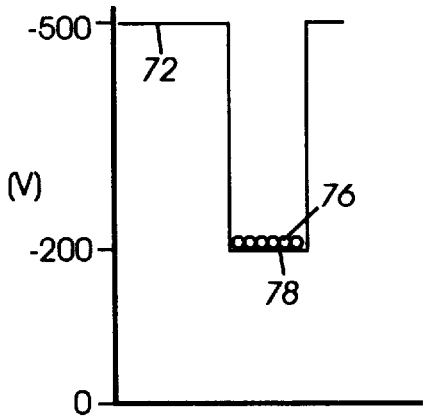
FIG. 2C shows a typical voltage profile of the image area after being developed.

FIG. 2C shows the voltages on the image area after the image area passes through the first development station C.

Toner 76 (which generally represents any color of toner) adheres to the illuminated image area. This causes the voltage in the illuminated area to increase to, for example, about −200 volts, as represented by the solid line 78. The unilluminated parts of the image area remain at about the level 72.

After passing through the first development station C, the now exposed and toned image area passes to a first recharging station D. The recharging station D is comprised of two corona recharging devices, a first recharging device 36 and a second recharging device 37, which act together to recharge the voltage levels of both the toned and untoned parts of the image area to a substantially uniform level. It is to be understood that power supplies are coupled to the first and second recharging devices 36 and 37, and to any grid or other voltage control surface associated therewith, as required so that the necessary electrical inputs are available for the recharging devices to accomplish their task.

Figure 2D:
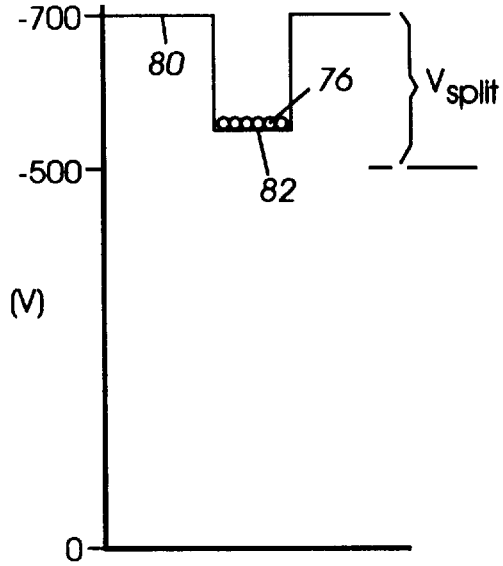
FIG. 2D shows a typical voltage profile of the image area after being recharged by a first charging device.

FIG. 2D shows the voltages on the image area after it passes through the first recharging device 36. The first recharging device overcharges the image area to more negative levels than that which the image area is to have when it leaves the recharging station D. For example, as shown in FIG. 2D the toned and the untoned parts of the image area, reach a voltage level 80 of about −700 volts. The first recharging device 36 is preferably a DC scorotron.

Figure 2E:
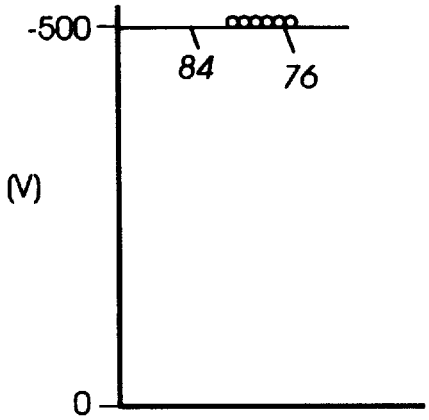
FIG. 2E shows a typical voltage profile of the image area after being recharged by a second recharging device.

After being recharged by the first recharging device 36, the image area passes to the second recharging device 37. Referring now to FIG. 2E, the second recharging device 37 reduces the voltage of the image area, both the untoned parts and the toned parts (represented by toner 76) to a level 84 which is the desired potential of −500 volts.

Figure 2F:
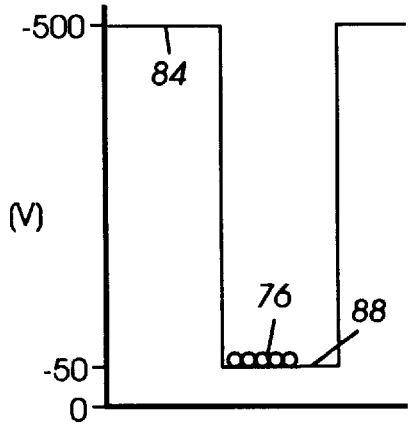
FIG. 2F shows a typical voltage profile of the image area after being exposed for a second time.

After being recharged at the first recharging station D, the now substantially uniformly charged image area with its first toner powder image passes to a second exposure station 38. Except for the fact that the second exposure station illuminates the image area with a light representation of a second color image (say yellow) to create a second electrostatic latent image, the second exposure station 38 is the same as the first exposure station B. FIG. 2F illustrates the potentials on the image area after it passes through the second exposure station. As shown, the non-illuminated areas have a potential about −500 as denoted by the level 84. However, illuminated areas, both the previously toned areas denoted by the toner 76 and the untoned areas are discharged to about −50 volts as denoted by the level 88.

The image area then passes to a second development station E. Except for the fact that the second development station E contains a toner 40 which is of a different color (yellow) than the toner 31 (black) in the first development station C, the second development station is beneficially the same as the first development station. Since the toner 40 is attracted to the less negative parts of the image area and repelled by the more negative parts, after passing through the second development station E the image area has first and second toner powder images which may overlap.

The image area then passes to a second recharging station F. The second recharging station F has first and second recharging devices, the devices 51 and 52, respectively, which operate similar to the recharging devices 36 and 37. Briefly, the first corona recharge device 51 overcharges the image areas to a greater absolute potential than that ultimately desired (say −700 volts) and the second corona recharging device, comprised of coronodes having AC potentials, neutralizes that potential to that ultimately desired.

The now recharged image area then passes through a third exposure 25 station 53. Except for the fact that the third exposure station illuminates the image area with a light representation of a third color image (say magenta) so as to create a third electrostatic latent image, the third exposure station 38 is the same as the first and second exposure stations B and 38. The third electrostatic latent image is then developed using a third color of toner 55 (magenta) contained in a third development station G.

The now recharged image area then passes through a third recharging station H. The third recharging station includes a pair of corona recharge devices 61 and 62 which adjust the voltage level of both the toned and untoned parts of the image area to a substantially uniform level in a manner similar to the corona recharging devices 36 and 37 and recharging devices 51 and 52.

After passing through the third recharging station the now recharged image area then passes through a fourth exposure station 63. Except for the fact that the fourth exposure station illuminates the image area with a light representation of a fourth color image (say cyan) so as to create a fourth electrostatic latent image, the fourth exposure station 63 is the same as the first, second, and third exposure stations, the exposure stations B, 38, and 53, respectively. The fourth electrostatic latent image is then developed using a fourth color toner 65 (cyan) contained in a fourth development station 1.

To condition the toner for effective transfer to a substrate, the image area then passes to a pretransfer corotron member 50 which delivers corona charge to ensure that the toner particles are of the required charge level so as to ensure proper subsequent transfer.

After passing the corotron member 50, the four toner powder images are transferred from the image area onto a support sheet 52 at transfer station J. It is to be understood that the support sheet is advanced to the transfer station in the direction 58 by a conventional sheet feeding apparatus which is not shown. The transfer station J includes a transfer corona device 54 which sprays positive ions onto the backside of sheet 52. This causes the negatively charged toner powder images to move onto the support sheet 52. The transfer station J also includes a detack corona device 56 which facilitates the removal of the support sheet 52 from the printing machine 8.

After transfer, the support sheet 52 moves onto a conveyor (not shown) which advances that sheet to a fusing station K. The fusing station K includes a fuser assembly, indicated generally by the reference numeral 60, which permanently affixes the transferred powder image to the support sheet 52. Preferably, the fuser assembly 60 includes a heated fuser roller 62 and a backup or pressure roller 64. When the support sheet 52 passes between the fuser roller 62 and the backup roller 64 the toner powder is permanently affixed to the sheet support 52. After fusing, a chute, not shown, guides the support sheets 52 to a catch tray, also not shown, for removal by an operator.

After the support sheet 52 has separated from the photoreceptor belt 10, residual toner particles on the image area are removed at cleaning station L via a cleaning brush contained in a housing 66. The image area is then ready to begin a new marking cycle.

The various machine functions described above are generally managed and regulated by a controller which provides electrical command signals for controlling the operations described above.

Turning to development system 34 in greater detail, development system 34 includes a housing 44 defining a chamber 76 for storing a supply of developer material therein. Donor belt 42 is mounted on stationary roll 41. Stationary roll 41 and magnetic roller 46 are mounted in chamber 76 of housing 44. The magnetic roller 46 can be rotated in either the "with" or "against" direction relative to the direction of motion of the toner on donor belt . Similarly, toner on belt 42 can be traveling in either the "with" or "against" direction relative to the direction of motion of the photoconductive belt. Donor belt comprises a flexible circuit broad having finely spaced electrode array 200 thereon as shown in FIGS. 4 and 5.

The electrode array 200 has a four phase grid structure consisting of electrodes 202, 204, 206 and 208 having a voltage source operatively connected thereto in the manner shown in order to supply AC or DC voltage in the appropriate electrode area groups A-F It is preferred to have the spacing between each electrode equal to the width of each electrode. It has been found by the Applicants that having the spacing between each electrode equal to the width of each electrode improves transportability of belt (ie reduced electric field holding back on the movement of toner) to move toner and also enables the use of lower voltages to move the toner on the belt. The spacing of electrodes is preferably 3 mils and the preferred width of each electrode is 3 mils. The preferred flexible circuit broad consist of a 2 mil thick polyimide film having metal electrodes such as Cu, preferably the thickness of the electrodes is 5 to 8 microns.

Loading of toner onto donor belt: Power source 220 applies an electrical bias between on electrodes 202, 204, 206 and 208. In electrodes group area A, for example, are DC bias from 500V to 100V is applied to electrodes 202, 204, 206 and 208 to extract toner from carrier.

Figure 6:
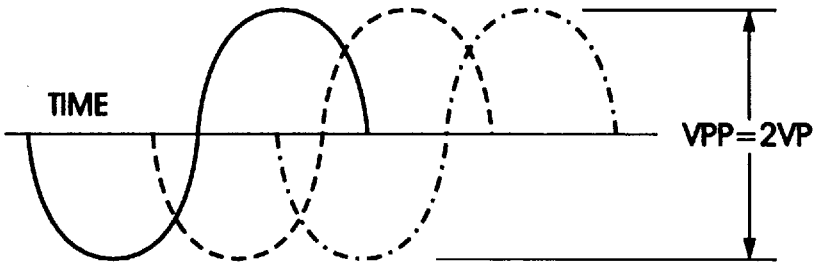
FIG. 6 PRIOR ART
FIG. 6 and 7 are waveforms which can be employed with the present invention.

Transporting of toner to development zone: In electrode group area B, electrodes 202, 204, 206 and 208 are phase with a DC traveling wave (500V to 1000V) to transport toner to the development zone. A typical operating frequency is between 2 Khz to 5 Khz. The travel wave can be DC Phase or AC Phase, however DC Phase is preferred. FIG. 6 shows the wave form of the three (multi) phase AC system. The force f required for moving toner is F=QE, where $E_f$ is the tangential field supplied by the multi phase system at any time $E_f$ =(1/d)(Vph1−Vph2) in this equation, d is the spacing between the two electrodes and is usually fixed. Vph1 and Vph2 are the voltages of the two adjacent electrodes respectively and vary as a function of time.

For a Peak AC voltage VP the resulting E field is equal to (1/d)[VpSin(wt)+Vpsin(wt+P)] where P is the phase difference between the two voltage waveform. The maximum electric filed depends on the phase of the waveform. The E field is largest when the phase between the two waveforms is equal to 180 degrees. And in this case the it is equal to 2VP/d.

However, a sinusoidal system can never achieve this maximum value because with a 180 degree phase shift in the waveform, the structure looses directionality. In other words, the toner will not be able to choose between the prior and previous electrodes.

Figure 7:
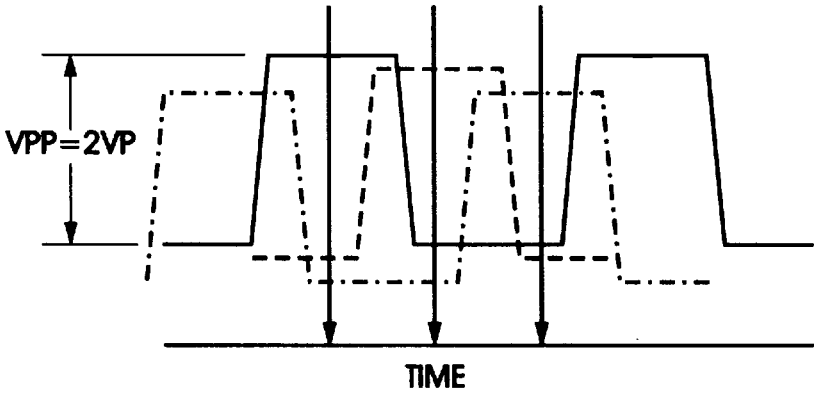

FIG. 7 shows the Phased DC waveforms preferably employed in the present invention that achieves both the directionality and maximum electric field for moving the toner around. The trapezoidal waveform delivers the maximum electric filed available for moving the toner in this case is equal to 2VP/d. This happens during the time that voltage of the two of the three phases are equal to zero. At the same time, the waveform has sufficient overlap to move the toner in one direction.

Among the advantages of this waveform is that as long as there is a non overlap region between the two phased DC waves, the peak available electric field for moving toner particles will be maximum. The second advantage of this waveform is the ease of generating it with High voltage electronics.

Figure 8:
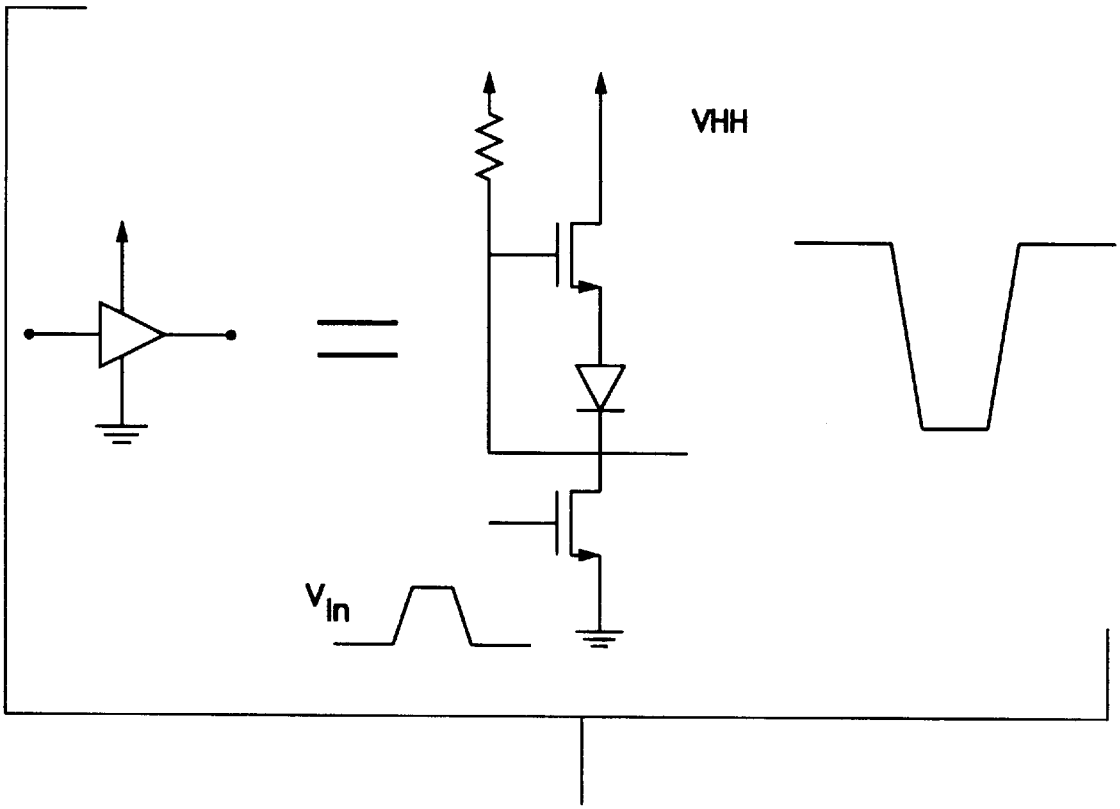
FIG. 8 is phase circuitry which can be employed with the present invention.

FIG. 8 shows the circuit for generating this waveform. Two conventional high voltage transistors plus a diode forms a push pull output driver that can take the "digital" signal Vin and translate it to a high voltage waveform Vo. For each phase one set of driver circuit would be necessary. The multi phase digital waveforms would be generated by conventional low voltage logic circuits.

Another advantage of the Phased DC toner transport system is that it is unipolar. This means that it is only capable of transporting the right sign toner. In the case described positive voltages can only be used to transport negatively charged toner. This is ability to choose the right sign toner and only transfer that to the photoreceptor is extremely important in reproducing high quality images.

Development of image with toner: In the development zone, electrodes group area C, electrodes 202 and 206 are DC bias from 0 to 1,000 volts is applied to the electrodes. The AC voltage applied between the electrodes 204 and 208 establishes AC fringe fields serving to liberate toner particles from the surface of the donor belt 42 to form the toner cloud 112 in the development zone. The AC voltage is referenced to the DC bias applied to the electrodes so that the time average of the AC bias is equal to the DC bias applied. Thus, the equal DC bias on adjacent electrodes precludes the creation of DC electrostatic fields between adjacent electrodes which would impede toner liberation by the AC fields the development zone.

When the AC fringe field is applied to a toner layer via an electrode structure in close proximity to the toner layer, the time-dependent electrostatic force acting on the charged toner momentarily breaks the adhesive bond to cause toner detachment and the formation of a powder cloud or aerosol layer 112. The DC electric field from the electrostatic image controls the deposition of toner on the image receiver.

The applied AC establishes an alternating electrostatic field between the adjacent electrodes which is effective in detaching toner from the surface of the donor roller and forming a toner cloud 112, the height of the cloud being such as not to be substantially in contact with the belt 10, moving in direction 16, with image area. The magnitude of the AC voltage is on the order of 800 to 1,200 volts peak at a frequency ranging from about 1 kHz to about 6 kHz. A DC bias supply, which applies approximately −300 volts to donor belt 42 establishes an electrostatic field between photoconductive surface 12 of belt 10 and donor belt 42, for attracting the detached toner particles from the cloud to the latent image recorded on the photoconductive surface. An AC voltage of 800 to 1,200 volts produces a relatively large electrostatic field in the development zone without risk of air breakdown.

Transporting of toner to the unloading zone: the transportation of toner to the unloading zone is identical to the transportation of toner to the development zone in which electrodes group area Dare also phased DC to transport toner to the unload zone.

Unloading toner from belt: electrodes group area E are bias relative to the donor belt so that toner is repelled from the surface thereof to the chamber.

As successive electrostatic latent images are developed, the toner particles within the chamber 76 are depleted to an undesirable level. A toner dispenser (not shown) stores a supply of toner particles. The toner dispenser is in communication with chamber 76 of housing 44. As the level of toner particles in the chamber is decreased, fresh toner particles are furnished from the toner dispenser. While in the chamber the toner particles are mixed with the carrier material by augers 88 and 86. In this manner, a substantially constant amount of toner particles are in the chamber of the developer housing with the toner particles.

Other embodiments and modifications of the present invention may occur to those skilled in the art subsequent to a review of the information presented herein; these embodiments and modifications, as well as equivalents thereof, are also included within the scope of this invention.

We claim:

1. An apparatus for transporting charged particles in a predetermined path of movement comprising:

a donor member for moving charged particles on a surface thereof in the predetermined path, said donor member includes an electrode array on the surface thereof, said array including a plurality of spaced apart electrodes extending substantial across width of the surface of the donor member; and a multi-phase DC voltage source operatively coupled to said electrode array, said multi-phase DC voltage source generating an electrodynamic wave pattern for moving charged particles on the surface of the donor member.

2. The apparatus of claim 1, wherein said multi-phase DC voltage source generates a trapezoidal waveform.

3. The apparatus of claim 1, wherein said multi-phase DC voltage source operates between 300 to 500 volts.

4. The apparatus of claim 1, wherein said multi-phase DC voltage source operates between 2 to 5khz.

5. An apparatus for developing a latent image recorded on an imaging surface, comprising:

a housing defining a chamber storing a supply of developer material comprising toner;

a donor member spaced from the imaging surface for transporting toner on a surface of said donor member to a region opposed from the imaging surface, said donor member includes an electrode array on the surface of said donor member, said array including a plurality of spaced apart electrodes extending substantial across width of the surface of the donor member; and a multi-phase DC voltage source operatively coupled to said electrode array, said multi-phase DC voltage source generating an electrodynamic wave pattern for moving toner particles to and from a development zone for developing the latent image.

6. The apparatus of claim 5, wherein said multi-phase DC voltage source generates a trapezoidal waveform.

7. The apparatus of claim 5, wherein said multi-phase DC voltage source operates between 300 to 500 volts.

8. The apparatus of claim 5, wherein said multi-phase DC voltage source operates between 2 to 5 khz.

9. An electrophotographic printing machine, wherein an electrostatic latent image recorded on an imaging surface of a photoconductive member is developed to form a visible image thereof, wherein the improvement comprises:

a housing defining a chamber storing a supply of developer material comprising toner;

a donor member spaced from the imaging surface and for transporting toner on a surface of said donor member to a region opposed from the imaging surface, said donor member includes an electrode array on the surface of said donor member, aid array including a plurality of spaced apart electrodes extending substantial across width of the surface of the donor member; and a multi-phase DC voltage source operatively coupled to said electrode array, said multi-phase DC voltage source generating an electrodynamic wave pattern for moving loner particles to and from a development zone for developing the latent image.

10. The apparatus of claim 9, wherein said multi-phase DC voltage source generates a trapezoidal waveform.

11. The apparatus of claim 9, wherein said multi-phase DC voltage source operates between 300 to 500 volts.

12. The apparatus of claim 9, wherein said multi-phase DC voltage source operates between 2 to 5 khz.

* * * * *